US008401211B2

(12) United States Patent
Angst et al.

(10) Patent No.: US 8,401,211 B2
(45) Date of Patent: Mar. 19, 2013

(54) HEARING DEVICE WITH RF COMMUNICATION

(75) Inventors: Jan Angst, Hirzel (CH); Erich Dittli, Reichenburg (CH); Paul Portmann, Schindellegi (CH)

(73) Assignee: Phonak AG, Stafa (CH)

( * ) Notice: Subject to any disclaimer, the term of this patent is extended or adjusted under 35 U.S.C. 154(b) by 247 days.

(21) Appl. No.: 12/601,051

(22) PCT Filed: May 24, 2007

(86) PCT No.: PCT/EP2007/055043

§ 371 (c)(1),
(2), (4) Date: Nov. 20, 2009

(87) PCT Pub. No.: WO2008/141677

PCT Pub. Date: Nov. 27, 2008

(65) Prior Publication Data

US 2010/0172525 A1 Jul. 8, 2010

(51) Int. Cl.
*H04R 25/00* (2006.01)

(52) U.S. Cl. ..... 381/312; 381/320; 381/23.1

(58) Field of Classification Search ..... 381/315, 381/320, 312, 311, 72, 23.1
See application file for complete search history.

(56) References Cited

U.S. PATENT DOCUMENTS

| | | | | |
|---|---|---|---|---|
| 6,643,378 | B2 * | 11/2003 | Schumaier | 381/326 |
| 2004/0133066 | A1 | 7/2004 | Mann et al. | |
| 2006/0034474 | A1 | 2/2006 | Topholm et al. | |
| 2006/0045298 | A1 * | 3/2006 | Westerkull | 381/326 |
| 2006/0068842 | A1 | 3/2006 | Sanguino et al. | |
| 2007/0229369 | A1 * | 10/2007 | Platz | 343/702 |

FOREIGN PATENT DOCUMENTS

| | | | |
|---|---|---|---|
| DE | 3032311 | A1 | 3/1981 |
| DE | 3723809 | A1 | 1/1989 |
| EP | 1681903 | A2 | 7/2006 |
| WO | WO 9721325 | * | 4/1996 |
| WO | 9721325 | A1 | 6/1997 |
| WO | 9909799 | A2 | 3/1999 |

OTHER PUBLICATIONS

International Search Report for PCT/EP2007/055043 dated Apr. 11, 2008.
Written Opinion for PCT/EP2007/055043 dated Apr. 11, 2008.

* cited by examiner

*Primary Examiner* — Davetta W Goins
*Assistant Examiner* — Amir Etesam
(74) *Attorney, Agent, or Firm* — Pearne & Gordon LLP

(57) ABSTRACT

In a hearing device with an audio signal processing stage (3, 7, 5) and an Rf signal processing stage (9, 11) the Rf signal processing stage is realized in one module ($\mathbf{13}_a$), whereas the audio signal processing stage is realized in a second module ($\mathbf{13}_b$). The two modules are releasably interlinked by means of a releasable positive locking link (15).

16 Claims, 5 Drawing Sheets

HEARING DEVICE WITH RF COMMUNICATION

Figure 1:
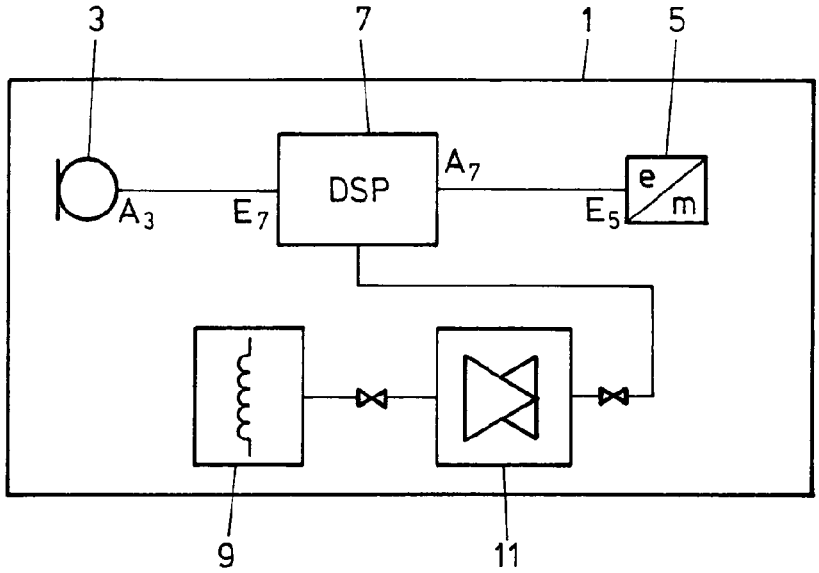

The present invention is generically directed on a hearing device which has Rf communication ability.

Definition

We understand under a hearing device a device which is worn adjacent to or in an individual's ear with the object to improve individual's acoustical perception. Such improvement may also be barring acoustical signals from being perceived in the sense of hearing protection for the individual.

If the hearing device is tailored so as to improve the perception of a hearing impaired individual towards hearing perception of a standard individual, then such hearing device is called a hearing aid device.

With respect to the application area a hearing device may be applied behind the ear, in the ear, completely in the ear canal or may be at least in part implanted.

Hearing devices which have Rf communication ability are known. Such Rf communication abilities may be provided to communicate with an external receiver, which may be applied at a second hearing device, and/or transmission station.

Via such communication control signals, status signals, acknowledgement signals, audio signals etc. may be transmitted between the external station and the hearing device mono- or bidirectionally.

Definition

We understand under audio signals which are not acoustical but which represent acoustical signals. They are acoustical signals converted e.g. for wireless transmission or for wire-bound transmission.

Hearing devices with Rf communication ability become more and more important e.g. for binaural hearing systems. We understand under Rf communication also UWB (ultra wide band) communication.

Definition

We understand under a binaural hearing system a system which comprises two hearing devices, one for each ear of one individual. The devices of a binaural hearing system do mutually communicate. Thereby, exceptionally, only control signals may mono- or bi-directionally be transmitted between the hearing devices, but the advantages of binaural systems are then fully exploited if there is a mono- or even better bi-directional communication comprising audio signals.

The space for incorporating an Rf antenna in a hearing device is customarily very restricted.

Further, the Rf antenna is to be operationally connected to an Rf signal processing unit comprising amplifier, modulator and/or demodulator, so as to convert a signal from a processing unit in the hearing device into a wirelessly transmittable mode or to bring a wirelessly received signal into a mode which is further processable in a signal processing unit of the hearing device. The hearing device comprises thus a stage for converting impinging acoustical signals to audio signals, then for signal processing such audio signals resulting in mechanical signals transmitted to individual's ear. We call such stage the "audio signal processing" stage of the hearing device. On the other hand the hearing device comprises an "Rf signal processing" stage. Thereby, utmost care should be taken to prevent Rf signals from mutually interfering with the audio signals as processed in the audio signal processing stage.

Further, in some appliances as e.g. and especially for binaural Rf communication, the transmitted signal power should be kept as low as possible in view of the involved head of the individual. This necessitates optimal mutual spatial orientation of the involved Rf antennas at each of the hearing devices of such a binaural hearing system.

In today's hearing devices with Rf communication ability the Rf antenna, as a distinct device, is customarily rigidly mounted into the hearing device, much similar to other distinct devices of such hearing device as e.g. the input acoustical-to-electrical converter arrangement, electronic processing units, which are today digital signal processing units etc. Thereby, providing an optimum shielding between Rf signals and audio signals is difficult and there is no flexibility of specifically selecting the spatial orientation of the antenna within the hearing device.

From the WO 00/79836 of the same applicant as the present application it is known to replace a battery of a hearing device by a plug-in module which has wireless communication ability and which incorporates the addressed battery for electrically supplying the overall device.

It is an object of the present invention to provide for a hearing device with Rf communication ability which significantly remedies the disadvantages of prior art devices.

This is realized by a hearing device according to the present invention with an acoustical-to-electrical converter arrangement, an electrical-to-mechanical converter arrangement, at least one audio signal processing unit with an input operationally connected to an output of the acoustical-to-electrical converter arrangement and with an output operationally connected to an input of the electrical-to-mechanical converter arrangement. Furthermore, the device has an Rf antenna and an Rf signal processing unit, the latter being operationally connected to the Rf antenna and to the audio signal processing unit. The Rf antenna is thereby incorporated in a first module and the audio signal processing unit is incorporated in a second module, whereby the first and the second modules are mechanically interconnected by a releasable positive locking link.

Due to the facts that at least the Rf antenna is incorporated in a module which is separate from a module incorporating the audio signal processing unit and that the two modules are easily mutually separable by the addressed releasable positive locking link, it becomes possible to easily exchange one of the addressed modules and thereby e.g. to apply different antennas and/or different spatially oriented antennas to the one module with the audio signal processing unit or to keep the module with specific antenna and specific space orientation thereof and to exchange the module with the audio processing unit.

In one embodiment of the hearing device the module with the audio signal processing unit has a casing with an inner space and the audio processing unit as well as the first module with the antenna are provided in that space and thus inside the casing.

Thereby, a highly compact combination of the two modules is achieved, which is especially true if, as a further embodiment, the addressed casing is realized by the outer shell of the hearing device which is adapted to the shape of an application area for the device at an individual's ear and is based also on aesthetic considerations for such hearing device applied to individual's ear.

Thus and in this embodiment the electronics of the hearing device, thereby especially the audio processing unit, the Rf signal processing unit, which are in one embodiment incorporated in one, namely the addressed second module, as well as the first module with the antenna may commonly be applied in different shells respectively suited to the respective individuals and ears. This significantly facilitates manufacturing, and further in case of any shell damage or damage of the inside electronics, either one may be exchanged, keeping the undamaged shell or electronics unexchanged.

In a further embodiment the second module has a casing or encapsulation as well and the first module is releasably mounted to the external of such casing. Especially if the addressed casing is realized by the outer shell of the hearing device, this gives a high flexibility of exchanging the first module with the antenna so as to find the best possible antenna and/or antenna orientation for a specific hearing device tailored for an ear of a specific individual.

Whenever the module with the antenna does not reside within the addressed casing, but at least the audio processing unit, the addressed casing may be a shielding casing made of electroconductive material, e.g. of a plastic material coated with one or more than one metal layers or made e.g. of an electroconductive plastic material or of a metal so as to establish accurate mutual shielding between at least Rf antenna and audio processing unit.

In a further embodiment of the device the first module comprising the addressed Rf antenna further comprises the Rf signal processing unit which, as was addressed, and in another embodiment, may also be part of the second module. Thereby, in this embodiment the overall Rf signal processing is performed in the first module which allows optimum constructional separation of audio signal processing and Rf signal processing and which additionally facilitates accurate mutual shielding. According to a further embodiment the Rf antenna and the Rf signal processing unit constitute an Rf receiver arrangement or an Rf transmitter arrangement or an Rf receiver and transmitter arrangement.

Thus, so as to exploit both advantages optimally, namely the possibility of accurately separating Rf processing, from audio processing and allowing easy electromagnetic shielding on one hand and of flexibility with respect to varying the antenna, the first module comprises the Rf antenna as well as the Rf signal processing unit. Thereby, in a further embodiment the first module comprises a first submodule with the Rf antenna and a second submodule which comprises the Rf signal processing unit. These submodules are mechanically interconnected by a releasable positive locking link. Thereby, the antenna submodule may be exchanged and replaced without affecting the Rf signal processing unit, the Rf signal processing unit may be exchanged and replaced without affecting the Rf antenna and additionally both, antenna and Rf signal processing unit may be exchanged and replaced without affecting the audio signal processing module and vice versa.

As was already addressed above, the hearing device according to the present invention is an in-the-ear hearing device or an outside-the-ear hearing device.

In a further embodiment the device is one hearing device of a binaural hearing device system, whereat mutual communication between the two devices is performed by means of the addressed antenna and Rf signal processing unit.

In a further embodiment of the hearing device according to the present invention the one releasable positive locking link between the first and second module and/or the releasable positive locking link between the first and the second submodules—if provided—is formed by a bayonet link, a screwing link, a snap link, a groove and tongue link as e.g. a dovetail type link. Thereby one of the addressed positive locking links may be conceived of one type of the links just addressed, the other one between the submodules, if provided, by the same or by another of the addressed links.

Still in a further embodiment of the hearing device according to the invention there is provided a code unit in or at a first one of the addressed modules or submodules and a code reader unit in a second of the addressed modules or submodules. Thereby, the one module which comprises the code unit is identified by a code provided in the code unit. By the code reader in the other one of the addressed modules or submodules, such code is read and subsequently decoded so that the module or submodule with the code is identified. By identifying in one of the modules or submodules another module or submodule which is attached, it becomes possible to adapt signal processing to the prevailing requirements of the module or submodule. Such mutual identification may e.g. be used to adjust amplification of the Rf processing unit to the needs of the audio signal processing unit and/or to the prevailing antenna. Alternatively the audio signal processing unit may be adapted to receive and process signals which are specifically generated by an Rf signal processing unit as identified.

It should be understood that the second module which comprises the audio signal processing unit additionally comprises further units of the hearing device, e.g. power supply unit, acoustical-to-electrical converter arrangement, electrical-to-mechanical converter arrangement, manually operable switches to control operation of the overall device, etc. additionally to the Rf signal processing unit incorporated therein in one of the embodiments. Thus, the second module may further consist of two or more than two submodules with respective units which are e.g. interlinked by respective releasable positive locking links of the types as have been addressed above, or as shown e.g. in the EP 0 453 200.

Thereby and with an eye upon Rf interferences with the audio signal processing, in one embodiment the second module comprises the acoustical-to-electrical converter arrangement as the output of such arrangement may be especially sensitive on Rf interferences.

If the hearing device further comprises an audio coil, a so-called T coil, in one embodiment such coil is provided within the first module with the Rf antenna.

The present invention will now be further described by examples of embodiments of the invention and with the help of figures.

Figure 2:
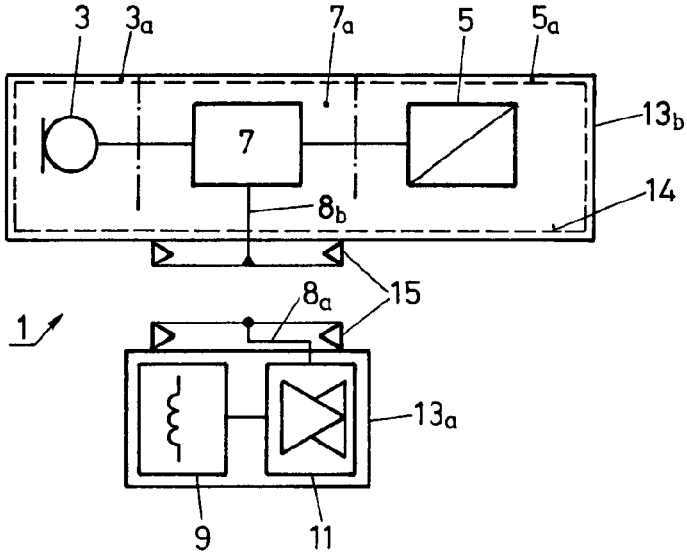
Figure 3:
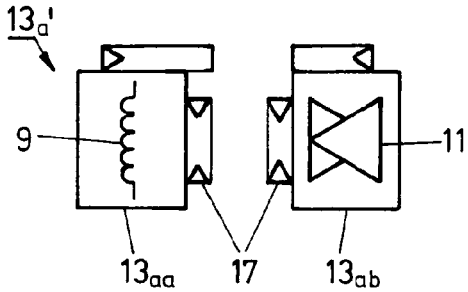
Figure 4:
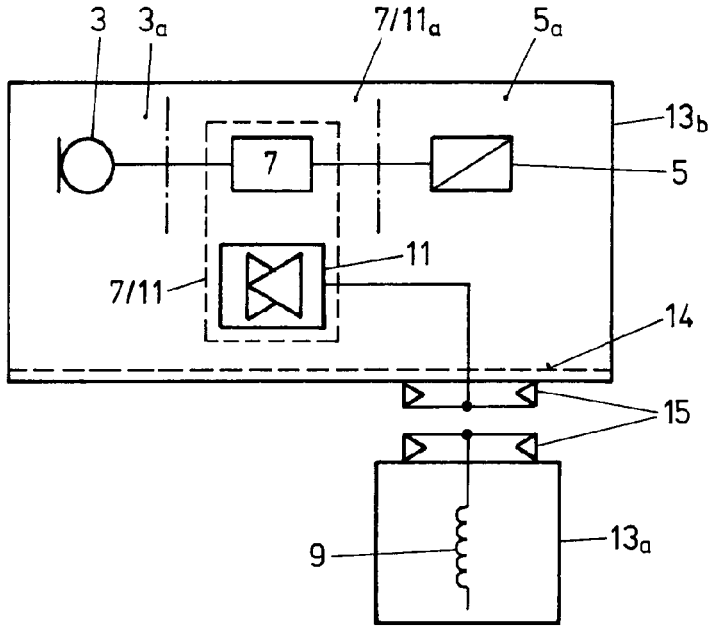
Figure 5:
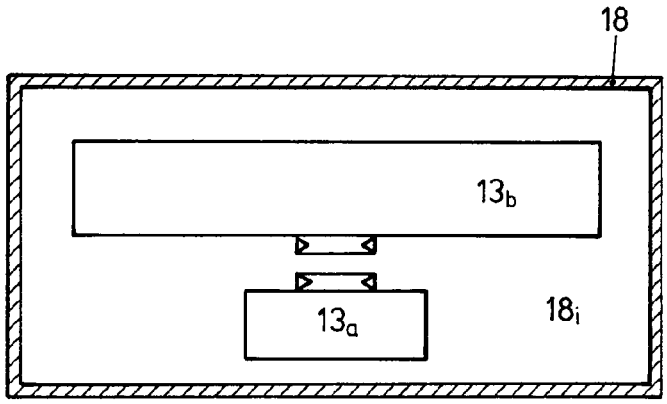
Figure 6:
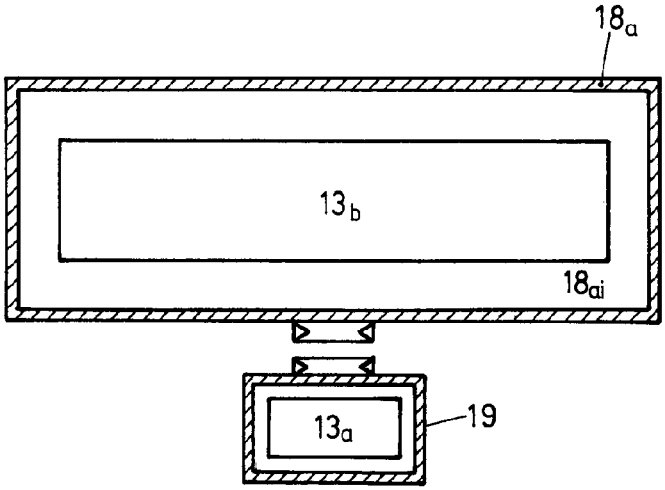
Figure 7:
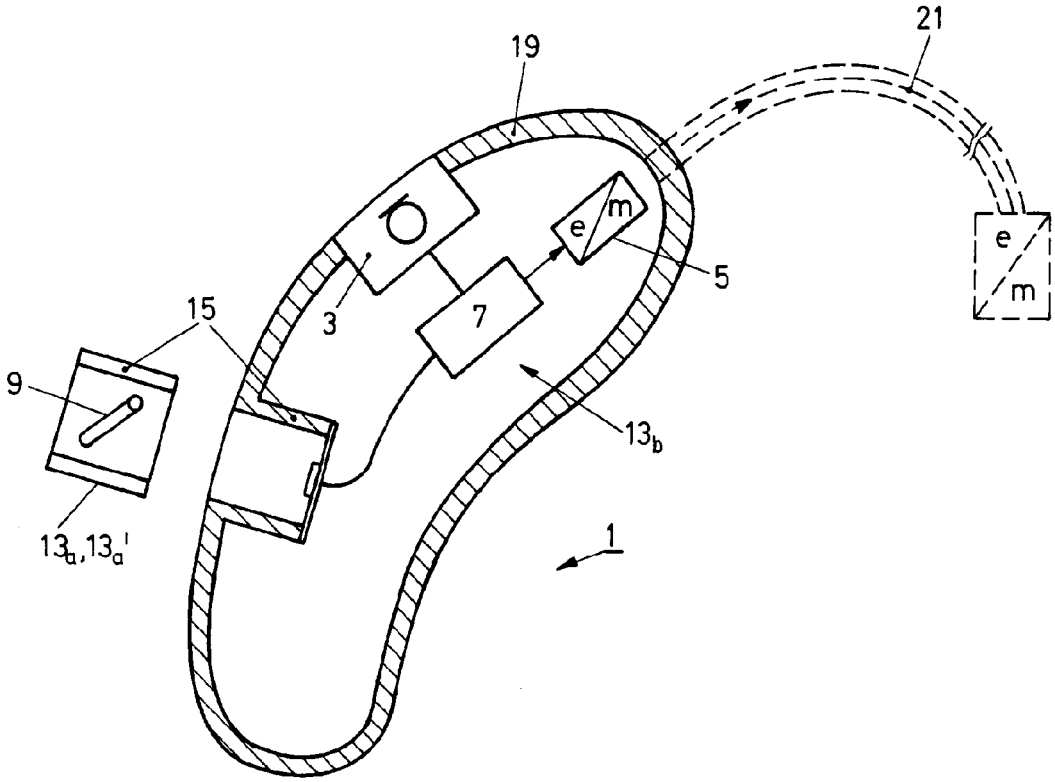
Figure 8:
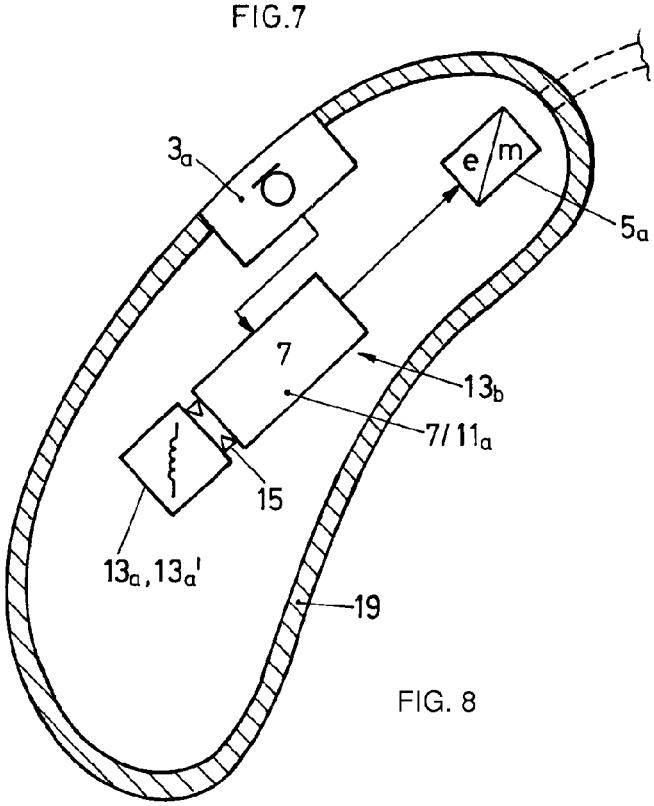
Figure 9:
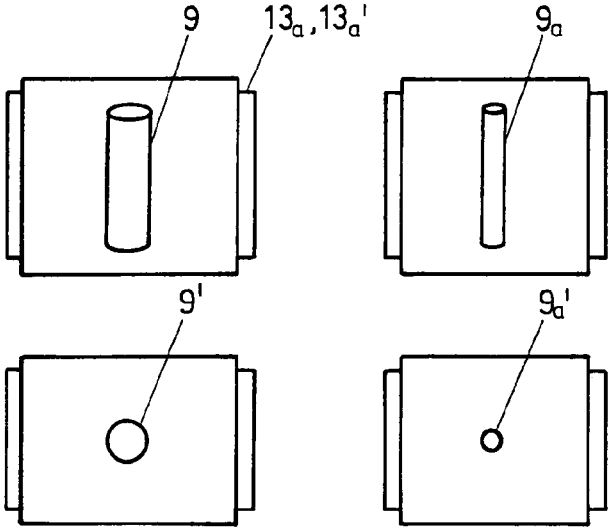
Figure 11:
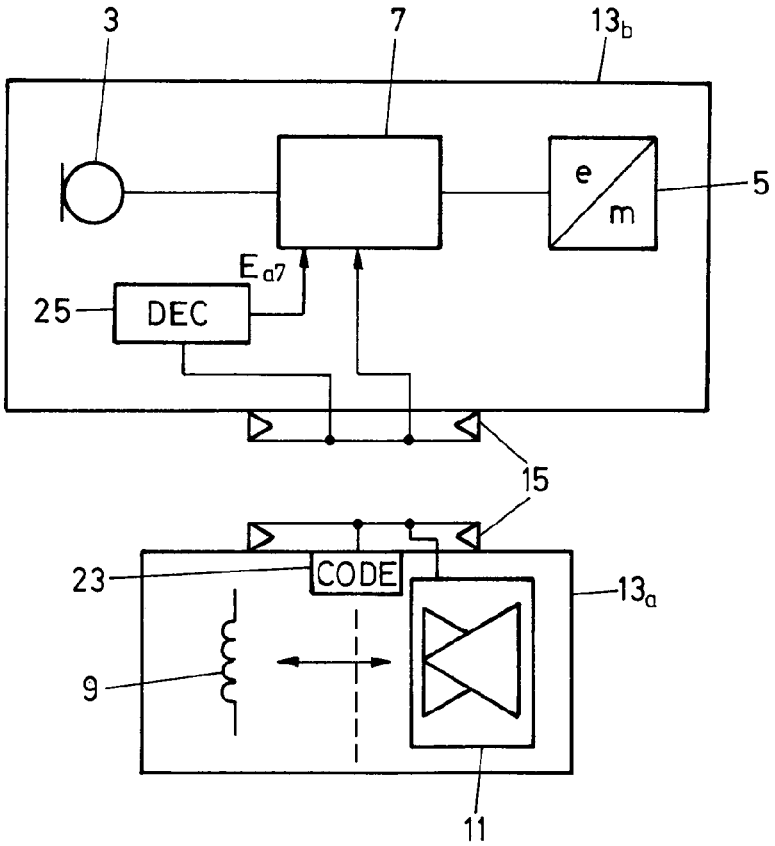
Figure 12:
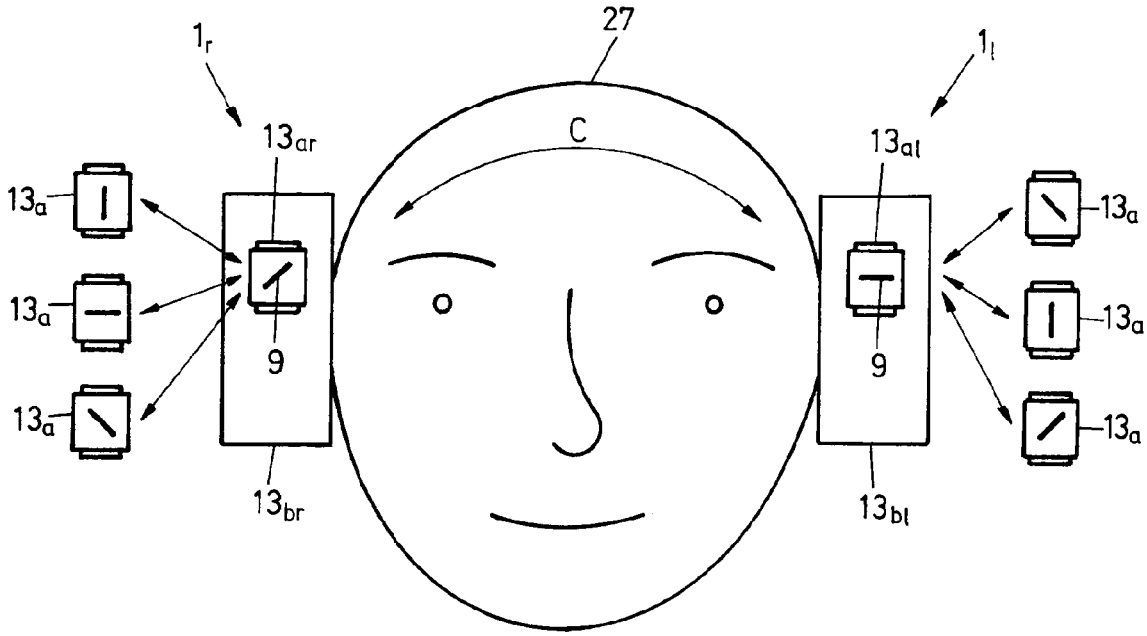

The figures show:

FIG. 1 schematically, a hearing device of the type whereupon the present invention is based;

FIG. 2 in a schematical and simplified representation in analogy to that of FIG. 1, a first embodiment of a hearing device according to the present invention;

FIG. 3 in a schematic and simplified representation in analogy to those of FIGS. 1 and 2, a further embodiment of one of the modules of a hearing device according to the present invention;

FIG. 4 in a schematic and simplified representation in analogy to that of FIGS. 1 to 3, a further embodiment of a hearing device according to the invention;

FIG. 5 in a simplified and schematic representation, one mode of providing an encapsulation or casing for modules at a hearing device according to the present invention;

FIG. 6 in a representation in analogy to that of FIG. 5, a second concept of providing an encapsulation or casing for the modules of the hearing device according to the present invention;

FIG. 7 schematically and simplified, a cross-section through an outside-the-ear hearing device according to the invention and according to the concept of FIG. 6;

FIG. 8 in a representation in analogy to that of FIG. 7, a cross-section through an outside-the-ear hearing device according to the invention and according to the concept of FIG. 5;

FIG. 9 simplified and schematically, four modules of one type applied to the hearing device according to the present invention with differently oriented or differently conceived Rf antennas;

FIG. 10*a* module according to FIG. 9, wherein the flexibility of spatially orienting an antenna in the module of the hearing device according to the present invention is schematically shown;

FIG. 11 schematically and simplified, a hearing device according to the invention in a further embodiment, and FIG. 12 most schematically, at least one hearing device according to the present invention applied as one device of a binaural system, schematically showing flexibility of adapting and optimizing Rf communication by selecting optimal mutual space orientation of the involved Rf antennas.

In FIG. 1 there is most generically shown a hearing device of the type whereupon the present invention is based. The hearing device 1 may be an in-the-ear hearing device, thereby a completely-in-the-canal hearing device or an outside-the-ear hearing device and may be a respective hearing aid device, and further one device of a binaural hearing system. The device 1 comprises an input acoustical-to-electrical converter arrangement 3, an output electrical-to-mechanical converter arrangement 5. The output $A_3$ of the input acoustical-to-electrical converter arrangement 3 is operationally connected to an input $E_7$ of an audio signal processing unit 7 which is or comprises, as customary today, at least one digital signal processing unit DSP. The output $A_7$ of the audio signal processing unit 7 is operationally connected to the input $E_5$ of the electrical-to-mechanical converter arrangement 5.

By the two converter arrangements 3 and 5 and the interconnected audio signal processing unit 7 the overall transfer characteristic between impinging acoustical signals and output mechanical signals is defined, which, as also customary for today's hearing devices, may be switched and altered in dependency of different acoustical and/or user specific considerations.

The hearing device 1 has further an Rf antenna 9 and an Rf processing unit 11. The Rf signal processing unit 11 is on one hand operationally connected to the antenna 9 and on the other hand to the audio signal processing unit 7. The Rf signal processing unit 11 comprises a modulator and/or demodulator stage. Wirelessly transmitted signals which may comprise control signals, status indication signals, audio signals, etc. are received by the Rf antenna 9 and are fed to the Rf signal processing unit 11. In the Rf signal processing unit 11 the received signals are respectively treated and demodulated so as to be brought into a format which is adapted to be read and further evaluated by the audio signal processing unit 7. This in the reception mode.

Thereby, it must be stated that when referring to the audio signal processing unit 7 it has to be understood that in fact this processing unit does primarily process audio signals but may be conceived to provide, additionally, all processor-based functions realized in the hearing device and may thus comprise different distinct processor units.

When the antenna 9 and the Rf signal processing unit 11 are conceived merely for signal transmission, signals, e.g. control signals, status signals and/or audio signals as generated in the audio signal processing unit 7 are fed to the Rf processing unit 11, where they are modulated upon an Rf carrier so as to be transmitted via the Rf antenna 9. The Rf antenna 9 and Rf signal processing unit 11 are nevertheless customarily conceived for mixed mode operation, i.e. as transmitter and receiver.

It might be seen that the hearing device 1 comprises two stages. On one hand the stage for receiving acoustical signals, processing respective audio signals and transmitting respective result signals to an individual. This audio processing stage comprises the input acoustical-to-electrical converter arrangement 3, the audio signal processing unit 7 and the electric-to-mechanical converter arrangements as predominant units. On the other hand the device 1 comprises an Rf processing stage with the predominant units antenna 9 and Rf signal processing unit 11, which in fact have to be conceived primarily with an eye on accurate wireless Rf transmission quality. The conception of the addressed Rf processing stage is substantially independent from the conception of the audio processing stage and vice versa. Thereby Rf signals processed in the Rf processing stage may interfere with processing in the audio processing stage as perfectly known to the skilled artisan.

In FIG. 2 there is shown in a representation in analogy to that of FIG. 1, a first embodiment of the present invention. Thereby, the audio signal processing unit 7 which is primarily sensitive to Rf interferences is built into a second module $\mathbf{13}_b$. According to the example of an embodiment according to FIG. 2 the input acoustical-to-electrical converter arrangement 3 as well as the output electrical-to-mechanical converter 5 are provided within the second module $\mathbf{13}_b$ too. A first module $\mathbf{13}_a$ comprises primarily the Rf antenna 9 and according to the embodiment of FIG. 2 additionally the Rf signal processing unit 11. The two modules $\mathbf{13}_a$, $\mathbf{13}_b$ are mechanically and electrically interconnectable by means of a releasable positive locking link 15. Such link 15 may e.g. be a bayonet-type link or a snap-in link or a groove and tongue link as e.g. a dovetail-type link. Thus, the two modules $\mathbf{13}_a$ and $\mathbf{13}_b$ may easily be separated and relinked manually. The electrical inteconnections as between audio signal processing unit 7 and Rf signal processing unit 11 as well as supply lines for electrically supplying the units within first module $\mathbf{13}_a$ from an electrical supply, as from a battery or accumulator preferably installed in second module $\mathbf{13}_b$ (not shown), are led via the releasable positive locking link. As the link 15 is established the inter-module electrical connections are established as well. This is schematically shown in FIG. 2 for the operational connection of audio signal processing unit 7 and Rf signal processing unit 11 via connection 8*a*, 8*b*.

Thus, by the concept according to FIG. 2 the audio signal processing stage of the hearing device is incorporated in one module $\mathbf{13}_b$, whereas the units for Rf processing are incorporated in a separate module $\mathbf{13}_a$, both modules being releasably linkable as was addressed.

In a further embodiment of the present invention and as shown in FIG. 3 in a representation in analogy to those of FIGS. 1 and 2 the first module $\mathbf{13}_a$ as of FIG. 2 is subdivided in a first submodule $\mathbf{13}_{aa}$ and a second submodule $\mathbf{13}_{ab}$. The first submodule $\mathbf{13}_{aa}$ comprises the antenna 9, whereas the second submodule $\mathbf{13}_{ab}$ comprises the Rf signal processing unit 11. The submodules $\mathbf{13}_{aa}$ and $\mathbf{13}_{ab}$ are linkable by a releasable positive locking link 17 which is conceived as was described in context with such locking link 15 for linking module $\mathbf{13}_a$ to $\mathbf{13}_b$ in the embodiment of FIG. 2.

Thus, the two submodules $\mathbf{13}_{aa}$ and $\mathbf{13}_{ab}$ may be releasably linked and the resulting first module $\mathbf{13}_a'$ may be linked to the second module $\mathbf{13}_b$, as of FIG. 2.

It becomes possible to flexibly apply to the second module $\mathbf{13}_b$ selectively different modules $\mathbf{13}_a$, so that whenever there is a need to optimize wireless Rf communication at an individual's hearing device, just the module $\mathbf{13}_a$ may be exchanged. Vice versa, if at an individual's hearing device a wireless communication is satisfying but not audio signal processing, module $\mathbf{13}_b$ may be exchanged, keeping module $\mathbf{13}_a$ unchanged.

Further, as was already addressed above, the hearing device may be one of the devices of a binaural system, whereat the two hearing devices wirelessly communicate via their respective Rf processing stages. It is known in this specific art that mutual spatial orientation of the respective Rf antennas at the two hearing devices is of predominant importance for optimum, low-power wireless communication between the two devices. With the hearing devices as exemplified in the FIG. 2 or 3 the module $\mathbf{13}_a$ as of FIG. 2 or the submodule $\mathbf{13}_{aa}$ as of FIG. 3 may easily be exchanged so that such modules or submodules with spatially differently oriented antennas 9 and/or with differently conceived antennas 9 may be applied. Thereby, for different individuals and different head shapes of such individuals differently oriented antennas may be applied. Additionally for one individual considered the optimum mutual spatial orientation of the antennas may be found by just exchanging module $\mathbf{13}_a$ as of FIG. 2 or submodule $\mathbf{13}_{aa}$ as of FIG. 3 at the hearing devices to experimentally find the best possible intercommunication between the two devices and the optimum mutual spatial orientation of the antennas 9.

The module $\mathbf{13}_b$ additionally incorporates normally the electrical supply for the hearing device such as a battery or rechargeable battery, one or more control switches operable by a user from the external of the hearing device (not shown) etc.

As further shown schematically in FIG. 2 by dashed lines, the second module $\mathbf{13}_b$ which comprises the audio signal processing unit 7 may be electromagnetically shielded by a shield arrangement 14.

In FIG. 4 there is shown in a representation in analogy to those of the FIGS. 1 to 3 a further embodiment of a hearing device according to the invention. Units and connections which have already been described are not described again and are referred to with the same reference numbers. In this embodiment the first module $\mathbf{13}_a$ comprises the Rf antenna 9 and the Rf signal processing unit 11 is incorporated within second module $\mathbf{13}_b$. Again an electromagnetic shielding 14 may be provided between the first and second modules $\mathbf{13}_a$ and $\mathbf{13}_b$.

As was already addressed in context with the other embodiments of the hearing device according to the invention, the first and second modules are releasably interlinked by the positive locking link 15. Having the audio signal processing unit 7 as well as the Rf signal processing unit 11 incorporated in the same module, the second module $\mathbf{13}_b$, has the advantage that these units may be conceived e.g. as a hybrid type signal processing unit 7/11 as shown in dashed lines in FIG. 4.

Further, and as shown in dash-pointed lines in FIG. 2 as well as in FIG. 4 the second module $\mathbf{13}_b$ may be subdivided in submodules which are interconnected by respective positive locking links. Such submodules may comprise a submodule $\mathbf{3}_a$ with the input acoustical to mechanical converter 3, a signal processing submodule $\mathbf{7}_a$ or $\mathbf{7/11}_a$ and an output electrical to mechanical submodule $\mathbf{5}_a$.

In context with the embodiment according to FIGS. 2 to 4 the modular conception according to the present invention has been described with the help of functional blocks.

According to the embodiment of FIG. 5 there is provided a casing 18 defining for an inner space $\mathbf{18}_i$. Both modules $\mathbf{13}_b$ and $\mathbf{13}_a$ which may be conceived in any variant as was explained in context with the FIGS. 2 to 4 are incorporated within the casing 18. Such casing 18 may thereby be the outer shell of a hearing device which is individualized so as to the shape of an application area for the device at an individual. Due to this concept as of FIG. 5, the casing 18 being realized by the outer shell, it becomes possible to provide equal modules $\mathbf{13}_a$ and $\mathbf{13}_b$ for different individuals to which the hearing device is individualized by the outer shell forming the casing 18.

In FIG. 6 a further embodiment of the hearing device according to the present invention is shown in a representation in analogy to that of FIG. 5. As becomes clear in this embodiment the second module $\mathbf{13}_b$ is mounted within a casing $\mathbf{18}_a$ which defines for an inner space $\mathbf{18}_{ai}$. The first module $\mathbf{13}_a$, as shown possibly also within a casing or encapsulation 19, is mounted to the external of casing $\mathbf{18}_a$. In this embodiment, in which again the modules may be conceived as was explained with the help of the FIGS. 2 to 4, the first module which comprises the antenna may easily be exchanged from the exterior of casing $\mathbf{18}_a$, which is especially advantageous if casing $\mathbf{18}_a$ is realized by the outer shell of a hearing device.

In FIG. 7 there is schematically shown an embodiment exemplified by an outside-the-ear device which accords with the embodiment of FIG. 6, at which casing $\mathbf{18}_a$ is realized by the outer shell of the hearing device. Thus, the casing $\mathbf{18}_a$ of FIG. 6 comprises or consists of the outer shell 19 of the hearing device and is shaped for properly fitting the application area behind the ear of an individual.

Inside shell 19 the second module $\mathbf{13}_b$ comprises, as was previously described, the input acoustical-to-electrical converter arrangement 3, the audio signal processing unit 7 and, either within shell 19 or at the end of a tubular extension 21 as shown in dashed lines, the electrical-to-mechanical converter arrangement 5. The first module $\mathbf{13}_a$ as of FIG. 2 or $\mathbf{13'}_a$ as of FIG. 3 is introducible into a recess of shell 19 and fixed by means of the releasable positive locking link 15. The same constructional concept may be realized for an in-the-ear hearing device.

The Rf signal processing unit 11 as of the FIG. 2 or 3 may thereby be incorporated in the second module $\mathbf{13}_b$ e.g. by providing a combined processing unit 7/11 or may be incorporated in first module $\mathbf{13}_a$ or $\mathbf{13}_a'$ as of FIG. 2 or 3.

In FIG. 8 there is shown a further embodiment of the hearing device according to the present invention which following up concept of FIG. 5 comprises both modules $\mathbf{13}_b$ and $\mathbf{13}_a$ or $\mathbf{13}_a'$ within a common casing 18 which is realized by the outer shell 19 of an outside-the-ear hearing device. The first module $\mathbf{13}_a$, $\mathbf{13}_a'$ according to one of the FIGS. 2 to 4 comprises at least the antenna 9 and is releasably mounted to the second module $\mathbf{13}_b$ by the lock 15. Thereby again, the Rf signal processing unit 11 (not shown) may either be part of first module $\mathbf{13}_a$ or of the second module $\mathbf{13}_b$, there e.g. integrated in a generic signal processing unit as has been addressed in context with FIG. 4. Having a look at the embodiments of FIGS. 7 and 8 it becomes apparent that the second module $\mathbf{13}_b$ may comprise submodules, e.g. submodules $\mathbf{5}_a$ and $\mathbf{3}_a$ respectively for the output electrical to mechanical converter and the input acoustical to mechanical converter and further with a submodule $\mathbf{7/11}_a$ as was addressed in context with FIG. 4.

In FIG. 9, still schematically, different first modules $\mathbf{13}_a$ or $\mathbf{13'}_a$ are shown. Each of the addressed modules as of FIG. 9 has either a different antenna 9 as shown at 9, **9*a*** and/or has such antennas which are differently oriented within the module and which once linked to the module $\mathbf{13}_b$, result in a different spatial orientation of the antenna with respect to the hearing device and thus with respect to the head of an individual wearing such device.

The antenna 9' in one respective module $\mathbf{13}_a$, $\mathbf{13'}_a$ of FIG. 9 is tilted by about 90° with respect to antenna 9 in a respective other module $\mathbf{13}_a$, $\mathbf{13'}_a$. The same is valid for the antennas **9*a* and 9*a'***.

Figure 10:
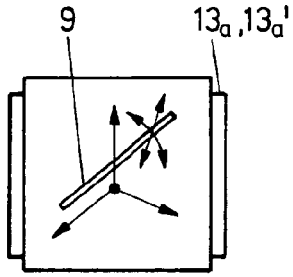

In FIG. 10 there is schematically shown that an antenna provided within a module $\mathbf{13}_a$ or $\mathbf{13}_a'$ may be freely oriented spatially according to the respective needs at the hearing device for a specific individual. Thus, it may be seen that with one and the same second module $\mathbf{13}_b$ differently oriented and different types of Rf antennas 9 may be flexibly applied, be it as a submodule according to the embodiment of FIG. 3 or be it within a unitary module incorporating the Rf signal processing unit as of FIG. 2, or be it in a first module $\mathbf{13}_a$ without Rf signal processing unit.

It must be stated that the second module $\mathbf{13}_b$ in all of the embodiments may comprise as was addressed submodules as well as e.g. for the electrical supply, the output electrical-to-mechanical converter as e.g. disclosed in the WO 02/11509 of the same applicant as the present invention or in the EP 0 453 200.

FIG. 11 shows in a representation in analogy to that of FIG. 2 a further embodiment of the hearing device according to the present invention. Thereby, for the units and elements which have already been described the same reference numbers are applied and such unit and elements are not described again. There is provided within the first module $\mathbf{13}_a$, which may also be conceived as show by the dashed lines by two submodules, a coding unit 23 containing a code which identifies the specific antenna 9 and, if provided in that module $\mathbf{13}_a$, the specific Rf signal processing unit 11. When $\mathbf{13}_a$ is linked to module $\mathbf{13}_b$ the code is transmitted to a code-reader and decoder unit 25 in module $\mathbf{13}_b$ which may be incorporated in audio signal processing unit 7. By identifying the module $\mathbf{13}_a$ by decoding there is generated an adaptation signal to an input $E_{a7}$ at the audio processing unit 7, which controls that unit 7 so as to accept and properly interpret signals which are received from the output of the specific Rf signal processing unit 11.

Inversely (not shown) there may be provided at the unit $\mathbf{13}_b$ a code unit with a code which identifies especially the audio signal processing unit 7 in module $\mathbf{13}_b$ for the Rf signal processing unit 11 now in module $\mathbf{13}_a$. There is provided in the module $\mathbf{13}_a$ a code-reader and decoder unit to which, once the two modules are linked, the code is transmitted. According to the decoding result the decoding unit transmits to the Rf signal processing unit information identifying audio signal processing unit 7. Thereby, the Rf signal processing unit 11 may be automatically set to deliver signals which are adapted to the needs of the audio signal processing unit 7. In analogy such a coding and decoding technique may be provided between a submodule $\mathbf{13}_{aa}$ and a submodule $\mathbf{13}_{ab}$ of first module $\mathbf{13}_a$ as of FIG. 3 especially to identify a specific antenna and to accordingly automatically adapt e.g. the gain of the Rf signal processing unit 11.

In FIG. 12 there is schematically shown a binaural system applied to an individual's head 27. The right ear hearing device $\mathbf{1}_r$ comprises the right ear second module $\mathbf{13}_{br}$ and the right ear first module $\mathbf{13}_{ar}$. First and second modules may thereby be conceived as has been described in context with FIGS. 2-11. The hearing device may be an in-the-ear or an outside-the-ear hearing device. The left ear hearing device $\mathbf{1}_l$ is conceived in analogy to the right ear hearing device $\mathbf{1}_r$. Thereby the two hearing devices may be of mixed types, e.g. one may be an in-the-ear hearing device, the other one an outside-the-ear hearing device. As schematically shown the respective first modules $\mathbf{13}_{ar}$ and $\mathbf{13}_{ab}$ have an antenna 9 mutually spatially oriented in a predetermined manner. Via the first modules $\mathbf{13}a_l$ and $\mathbf{13}a_r$ wireless binaural communication C is established between the hearing devices. So as to optimize such communication C and as schematically shown, the respective first modules $\mathbf{13}_a$ at one or both hearing devices may be exchanged and subsequently such modules may be inserted with differently spatially oriented antennas and/or with different types of antennas, up to finding optimum communication C.

Thus, FIG. 12 shows one example how, with the concept according to the hearing device of the present invention, highly flexible the Rf behaviour of hearing devices may be varied and adapted to prevailing needs, whereby additionally and as was addressed an optimum decoupling of Rf signals from sensitive areas along the audio signal transfer path and vice versa is easily achieved.

What is claimed is:

1. A hearing device with an acoustical-to-electrical converter arrangement, an electrical-to-mechanical converter arrangement, at least one audio signal processing unit with an input operationally connected to an output of said acoustical-to-electrical converter arrangement and with an output operationally connected to an input of said electrical-to-mechanical converter arrangement and further with an Rf antenna and an Rf signal processing unit operationally connected to said Rf antenna and to said audio signal processing unit, wherein said Rf antenna is incorporated in a first module and said audio signal processing unit is incorporated in a second module, said first and second modules being completely incorporated within an outer shell of the hearing device, said first and second modules being mechanically and electrically interconnected by a releasable positive locking link, wherein said first module with the Rf antenna is interchangeable with a different first module with a different Rf antenna having a different spatial orientation, and Rf communications of the hearing device are changed when the first module is replaced with the different first module.

2. The hearing device of claim 1, wherein said first module further comprises said Rf signal processing unit.

3. The hearing device of claim 1, wherein said second module further comprises said Rf signal processing unit.

4. The hearing device of claim 1, wherein said Rf antenna and said Rf signal processing unit constitute an Rf receiver arrangement or an Rf transmitter arrangement or an Rf receiver and transmitter arrangement.

5. The hearing device of claim 1, wherein said first module further comprises said Rf signal processing unit and wherein said first module comprises a first submodule comprising said Rf antenna and a second submodule comprising said Rf signal processing unit, said first and second submodules being mechanically interconnected by a releasable positive locking link.

6. The hearing device of claim 1 being one of an in-the-ear hearing device and of an outside-the-ear hearing device.

7. The hearing device of claim 1 being one hearing device of a binaural system.

8. The hearing device of claim 1, wherein said releasable positive locking link is one of a bayonet link, a screwing link, a snap link, and a groove and tongue link.

9. The hearing device of claim 1, further comprising a code unit in or at the first module and a code reader and decoding unit at or in the second module.

10. The hearing device of claim 1, wherein said second module comprises submodules which are interconnected by means of releasable positive locking links.

11. The hearing device of claim 1, wherein said second module further comprises said acoustical-to-electrical converter arrangement.

12. The hearing device of claim 1, further comprising an audio coil within said first module.

13. A hearing device with an acoustical-to-electrical converter arrangement, an electrical-to-mechanical converter arrangement, at least one audio signal processing unit with an input operationally connected to an output of said acoustical-to-electrical converter arrangement and with an output operationally connected to an input of said electrical-to-mechanical converter arrangement and further with an Rf antenna and an Rf signal processing unit operationally connected to said Rf antenna and to said audio signal processing unit, wherein said Rf antenna is incorporated in a first module and said audio signal processing unit is incorporated in a second module, said first and second modules being completely incorporated within an outer shell of the hearing device, said first module being introducible into a recess of said outer shell such that a surface of the first module is flush with a surface of said outer shell, and said first and second modules being mechanically and electrically interconnected by a releasable positive locking link, wherein said first module with the Rf antenna is interchangeable with a different first module with a different Rf antenna having a different spatial orientation, and Rf communications of the hearing device are changed when the first module is replaced with the different first module.

14. The hearing device of claim 13, wherein said first module has a casing.

15. A method for optimizing mutual Rf-communication between a first hearing device and a second hearing device of a binaural hearing system, comprising the steps of:

replacing, at the first hearing device, a module comprising an antenna having a spatial orientation with another module comprising another antenna having a different spatial orientation; and repeating the step of replacing using further modules comprising further antennas having further different spatial orientation until an optimum Rf communication is found.

16. The method of claim 15, wherein the step of replacing includes mechanically and electrically interconnecting said another module to a second module comprising an audio signal processing unit, using a releasable positive locking link, wherein said second module is incorporated within an outer shell of the first hearing device, and said another module is introducible into a recess of the outer shell or is incorporated within the outer shell.

* * * * *

UNITED STATES PATENT AND TRADEMARK OFFICE

CERTIFICATE OF CORRECTION

PATENT NO. : 8,401,211 B2
APPLICATION NO. : 12/601051
DATED : March 19, 2013
INVENTOR(S) : Angst et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 311 days.

Signed and Sealed this
First Day of September, 2015

Michelle K. Lee

Michelle K. Lee
*Director of the United States Patent and Trademark Office*